US006971301B2

(12) United States Patent
Johnson

(10) Patent No.: US 6,971,301 B2
(45) Date of Patent: Dec. 6, 2005

(54) ASYMMETRICALLY ACCELERATED VIBRATOR FOR FEEDING MATERIALS

(75) Inventor: Leroy A. Johnson, Port Royal, PA (US)

(73) Assignee: vibro Industries, Inc., Port Royal, PA (US)

( * ) Notice: Subject to any disclaimer, the term of this patent is extended or adjusted under 35 U.S.C. 154(b) by 64 days.

(21) Appl. No.: 10/705,694

(22) Filed: Nov. 10, 2003

(65) Prior Publication Data

US 2005/0098028 A1 May 12, 2005

(51) Int. Cl.[7] ..... F01B 7/18; F16K 31/363

(52) U.S. Cl. ..... 91/235; 91/321; 91/343; 137/901; 251/63.4

(58) Field of Search ..... 91/235, 276, 321, 91/325, 343; 137/533.11, 901; 251/63.4, 251/262

(56) References Cited

U.S. PATENT DOCUMENTS

| | | | | |
|---|---|---|---|---|
| 3,961,770 A | | 6/1976 | Wrasman | |
| 4,019,626 A | | 4/1977 | Kamner | |
| 4,339,029 A | | 7/1982 | Wilson | |
| 4,390,159 A | * | 6/1983 | Duncan | 137/901 |
| 4,436,199 A | | 3/1984 | Baba et al. | |
| 4,593,603 A | | 6/1986 | Johnson | |
| 5,351,807 A | | 10/1994 | Svejkovsky | |
| 5,404,996 A | | 4/1995 | Durnil | |
| 5,467,859 A | | 11/1995 | Sahlberg | |
| 5,579,890 A | | 12/1996 | Harris | |
| 5,593,136 A | | 1/1997 | Reed et al. | |
| 5,699,897 A | | 12/1997 | Svejkovsky | |
| 5,794,757 A | | 8/1998 | Svejkovsky et al. | |
| 5,850,906 A | | 12/1998 | Dean | |
| 6,079,548 A | | 6/2000 | Svejkovsky et al. | |
| 6,591,859 B2 | | 7/2003 | Shih | |

* cited by examiner

*Primary Examiner*—Edward K. Look
*Assistant Examiner*—Michael Leslie
(74) *Attorney, Agent, or Firm*—Duane Morris LLP

(57) ABSTRACT

An asymmetrical vibrator is provided, which is actuated by compressed air. The vibrator operates in a case, which has two bores disposed parallel on opposite sides of the casing. One of the bores is smaller than the second bore and the piston operating in the small bore is called the slow piston, since it is actuated with air to a relatively slow motion and the piston operating in the second larger bore is called the fast piston, since it is moves at a larger speed when driven directly by the compressed air. The asymmetric vibration motion can be employed to transport materials upwardly in factories and assembly stations. The air operated asymmetric vibrators need low maintenance and do not entail the spark dangers caused by the presence of electrical wiring for electrical drive motors.

27 Claims, 8 Drawing Sheets

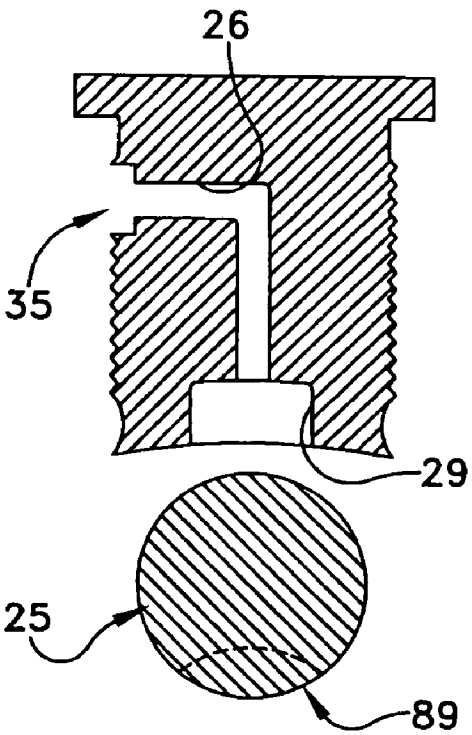
FIG. 4
FIG. 3
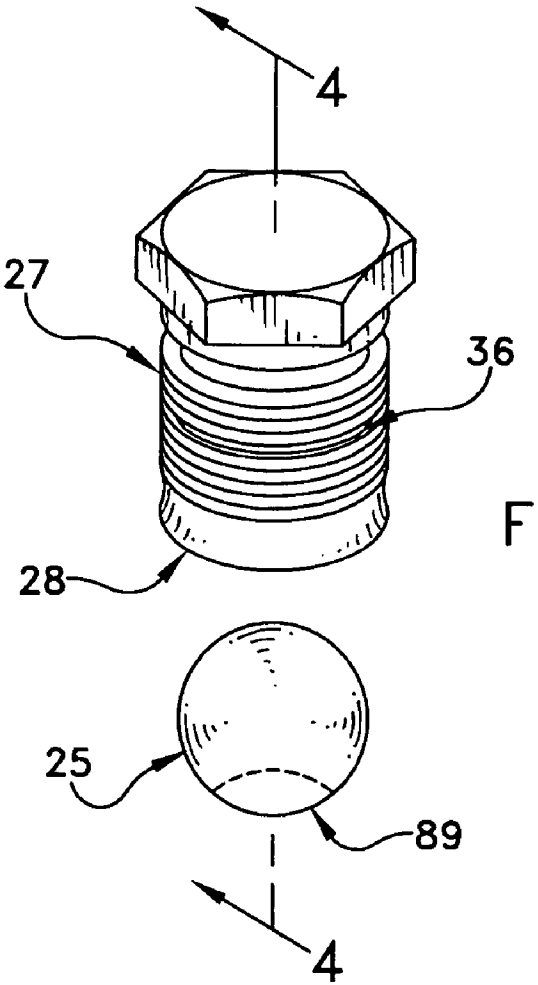

ASYMMETRICALLY ACCELERATED VIBRATOR FOR FEEDING MATERIALS

FIELD OF THE INVENTION

The present invention generally relates to vibratory feeding mechanisms and, more particularly to an improved asymmetrically accelerated vibrator which uses pistons activated by compressed air.

BACKGROUND OF THE INVENTION

A vibratory conveyor includes a generally elongate horizontal or slightly inclined tray or pan having a planar surface. The tray is moved slowly forward to shift the goods, relative to the planar surface of the tray, and is then pulled rearwardly at a high return acceleration so that the goods slide along the planar surface of the tray. In this way, the goods are effectively transported along the conveyor tray. Vibratory conveyors, which are sometimes referred to as differential impulse conveyors, linear motion conveyors, or shaker conveyors provide a significant advantage in that goods may be transported along the tray in a manner that does not require engagement with the parts by secondary fixtures or the like (no moving tray parts) which could damage the goods.

Various prior art mechanisms for driving vibratory conveyors are known in the art including reciprocating pistons, driven three and four bar linkages, and mechanisms employing a plurality of flywheels suspended from the tray. For example, U.S. Pat. Nos. 6,079,548; 5,850,906; 5,794,757; 5,699,897; 5,579,890; 5,404,996; 5,351,807; 4,593,603; 4,436,199; 4,339,029; and 4,019,626 disclose drive mechanisms suitable for use with vibratory conveyors.

In U.S. Pat. No. 4,593,603, issued to Johnson, an asymmetrical vibrator is provided which is actuated by compressed air. The vibrator operates in a case which has two parallel bores disposed on opposite sides of the case. One of the bores is smaller than the other. A piston operates in the smaller bore, and is called the slow piston. The slow piston is actuated with air to a relatively slow motion. A piston also operates in the larger bore, and is called the fast piston. The fast piston moves at a higher speed when driven by compressed air. This structure results in asymmetric vibratory motion, which can be employed to transport materials. Johnson utilizes a poppet valve to regulate the exchange of compressed air between the bores. This standard has been quite prone to severe wear, which shortens its useful working life and degrades the performance of the overall device. An improved means of regulating compressed air exchange in asymmetrically accelerated vibrators is desirable to overcome these problems.

SUMMARY OF THE INVENTION

The present invention provides an asymmetrically accelerated vibrator having a case defining a first bore and a second bore that are arranged in coaxial relation to one another. The first and second bores are also arranged in regulated fluid communication with a source of compressed fluid. A first piston having a first diameter is disposed in the first bore, and a second piston having a second diameter is disposed in the second bore. A mechanical connection between the first and second pistons is provided such that those pistons are caused to oscillate in unison by regulated application of compressed fluid from the compressed fluid source. A ball-valve is disposed in fluid regulatory relation between the first bore, the second bore, and the source of compressed fluid. In this way, a flow of the compressed fluid may be switched between the first bore and the second bore upon interaction with a portion of the second piston.

In an alternative embodiment of the invention, an asymmetrically accelerated vibrator is provided that includes a case having a first open-ended chamber and a second open-ended chamber that are arranged in coaxial relation to one another. The first and second open-ended chambers are also arranged in regulated fluid communication with a source of compressed fluid. A first piston having a first diameter is disposed in the first open-ended chamber, and a second piston having a second diameter is disposed in the second open-ended chamber. A compressed fluid conduit is defined within the case, and arranged in fluid communication between a compressed fluid intake port and a threaded recess that is defined in the case between the first open-ended chamber and the second open-ended chamber. The threaded recess is terminated by a radiused seat-wall having a through-bore that opens into the second open-ended chamber. A mechanical connection between the first and second pistons is provided such that those pistons are caused to oscillate in unison by regulated application of compressed fluid from the compressed fluid source. A ball-valve is disposed within the threaded recess such that when the ball-valve is engages the seat-wall, a segment of the ball-valve projects into the second open-ended chamber. This segment is engagable by a portion of the second piston. In this way, fluid flow regulation is provided between the first open-ended chamber, the second open-ended chamber, and the source of compressed fluid so as to switch a flow of the compressed fluid between the first open-ended chamber and the second open-ended chamber upon interaction of the segment of the ball-valve with the portion of the second piston.

In another embodiment, an asymmetrically accelerated vibrator is provided that includes a case having a first bore and a second bore arranged in coaxial relation to one another and in regulated fluid communication with a source of compressed fluid. A first piston is provided having a first diameter and disposed in the first bore. A second piston is also provided having a second diameter and disposed in the second bore. The second piston also includes a compound valve that is positioned within the second bore, and comprises a valve-actuator projecting therefrom. The valve-actuator includes a chamfered end that is suitable for engaging an alternating portion of a ball-valve. A mechanical connection is formed between the first and second pistons such that the pistons are caused to oscillate in unison by regulated application of compressed fluid from the compressed fluid source. The ball-valve is disposed in fluid regulatory relation between the first bore, the second bore, and the source of compressed fluid so as to switch a flow of the compressed fluid between the first bore and the second bore upon interaction with the chamfered end.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein:

FIG. 3 is a perspective view of a threaded stem and ball valve formed in accordance with the present invention;

FIG. 4 is a cross-sectional view of the threaded stem and ball-valve shown in FIG. 3;

DETAILED DESCRIPTION OF THE PREFERRED EMBODIMENT

Figure 1:
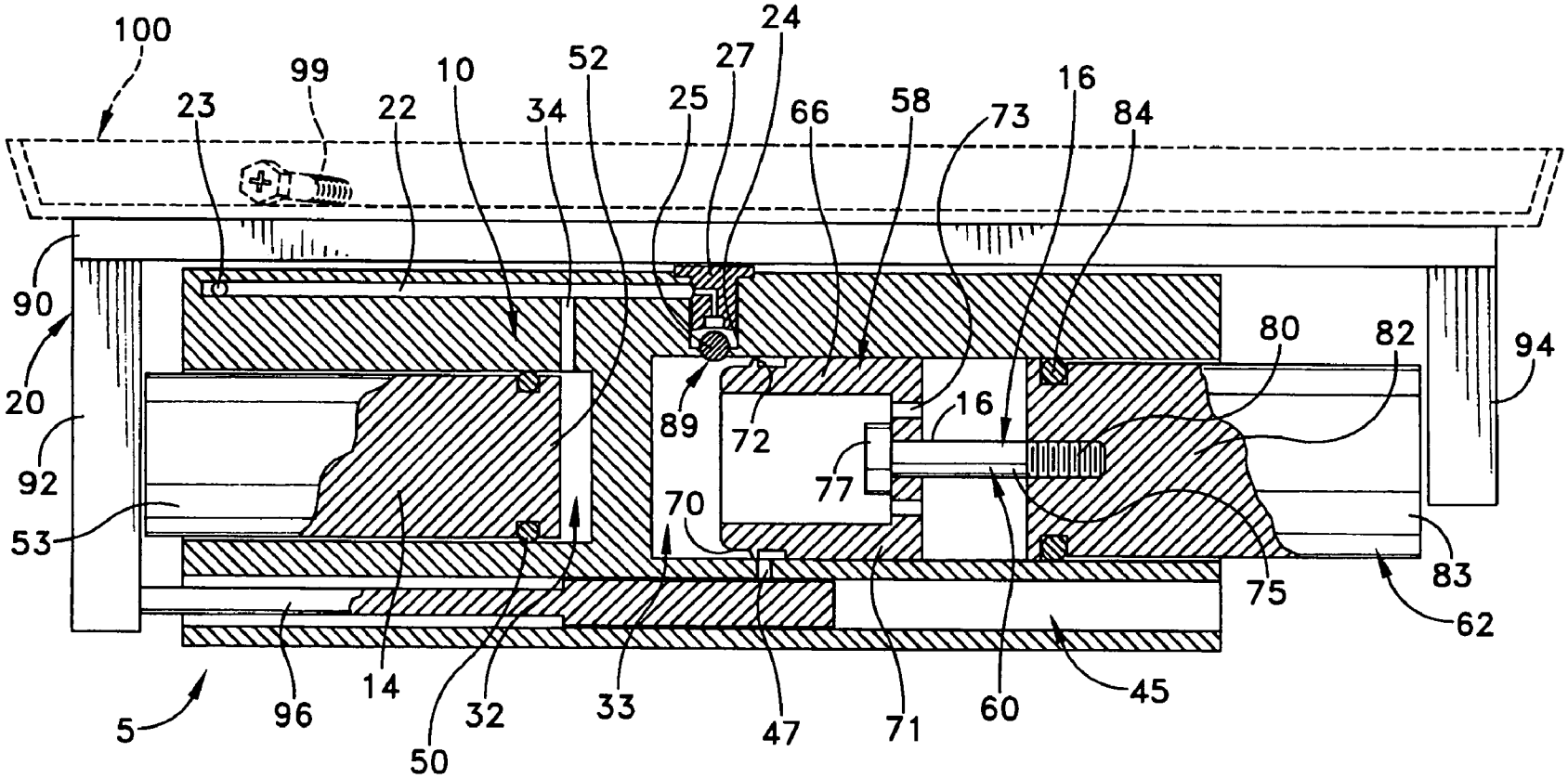
FIG. 1 is a cross-sectional elevational view of an asymmetrically accelerated vibrator formed in accordance with the present invention.
Figure 2:
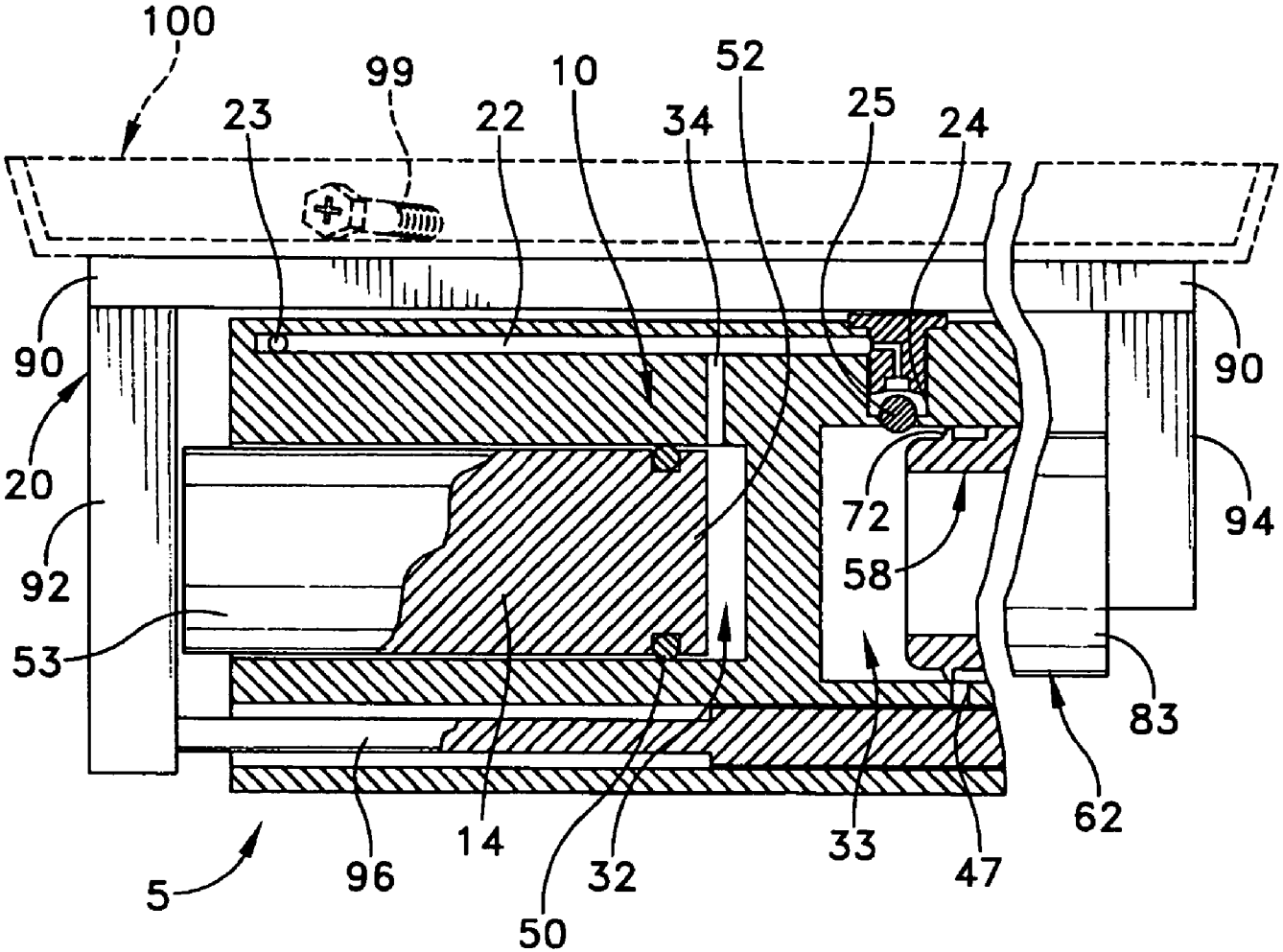
FIG. 2 is a broken-way portion of the asymmetrically accelerated vibrator shown in FIG. 1.
Figure 5:
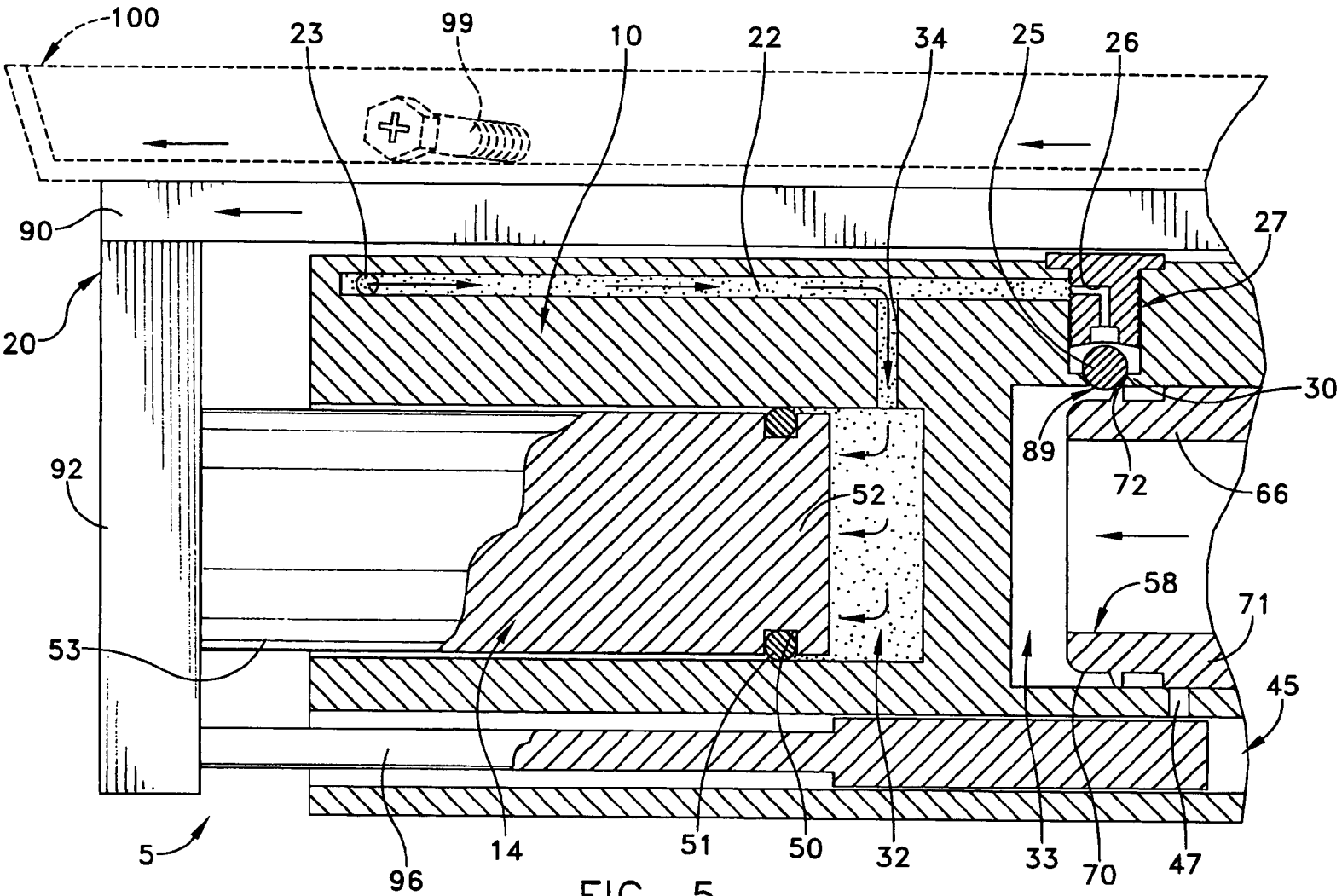
FIG. 5 is an enlarged broken-way view of a side portion of the asymmetrically accelerated vibrator shown in FIGS. 1 and 2, showing an initial charging of gas for operation of the device.
Figure 6:
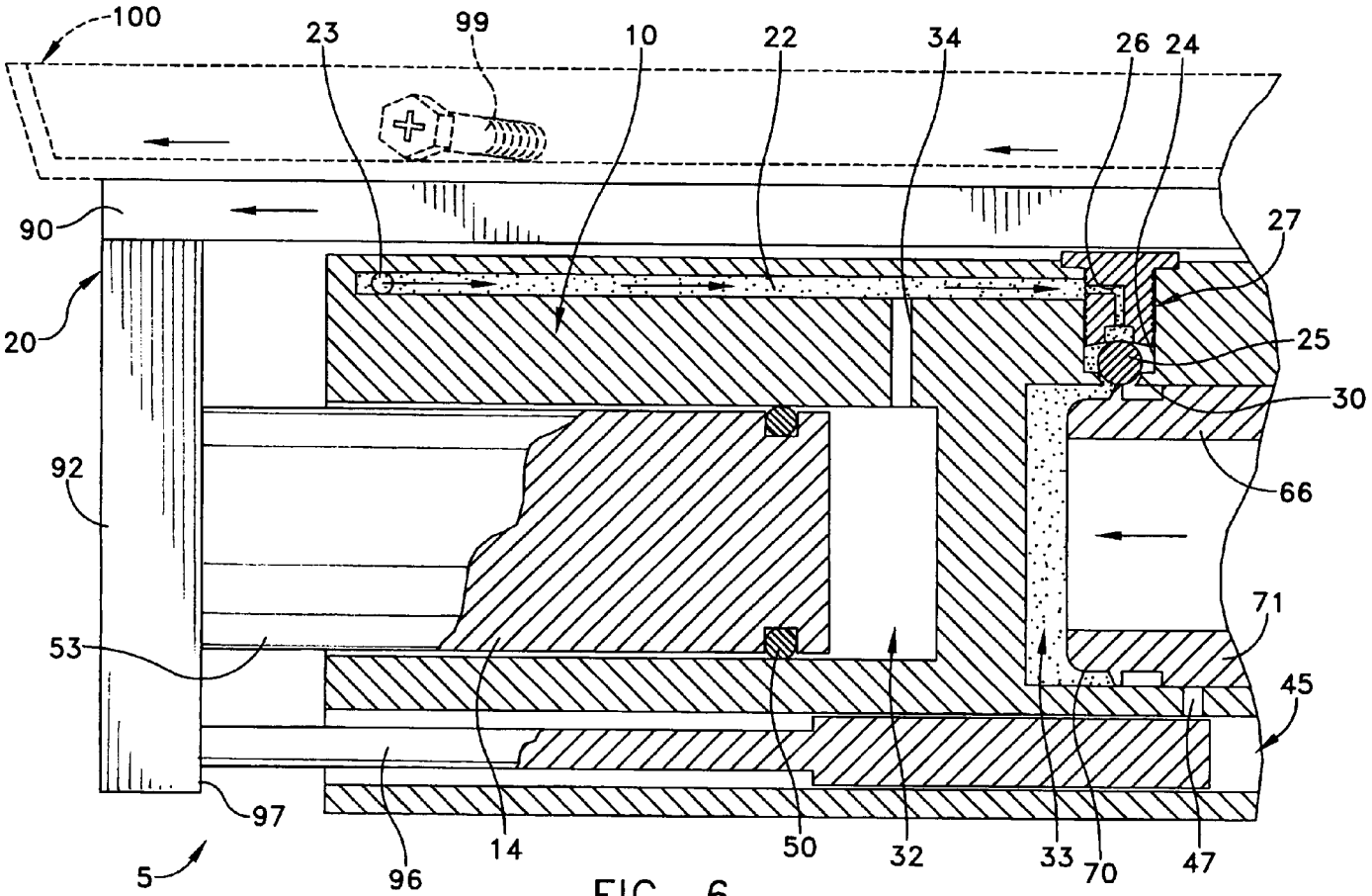
FIG. 6 is an enlarged broken-way cross-sectional view similar to FIG. 5, but showing a subsequent stage of operation of the device in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIG. 1, an asymmetrically accelerated vibrator 5 formed in accordance with the present invention comprises a case 10, a piston 14, a piston assembly 16, and a vibratory carriage assembly 20. More particularly, case 10 is generally rectilinear in outer profile, and is preferably made from a stable material suitable for structural support, such as, cast iron, aluminum and plastic. An air conduit 22 is defined within an upper portion of case 10. Air conduit 22 is arranged in fluid communication between an air intake port 23 and a threaded recess 24, that is often defined in a central portion of case 10. Threaded recess 24 is sized and shaped to receive a substantially spherical ball-valve 25 and a correspondingly threaded stem 27. Ball-valve 25 is often formed from a light weight, wear and corrosion resistant material, such as, aluminum alloys or glass-filled polymers (FIGS. 3 and 4). Threaded stem 27 includes a radiused bottom end 28 and a central passageway 26. Central passageway 26 communicates with an opening 35 (FIG. 4) located within the threads on the outer surface of threaded stem 27. A semi-circumferential slot 36 is often formed in threaded stem 27 so as to intersect with opening 35 (FIGS. 3 and 4).

Threaded recess 24 in case 10 comprises a radiused, i.e., curved, seat-wall 30 having a centrally defined through-bore 31 that provides for fluid communication with the interior of threaded recess 24 (FIGS. 5–7 and 9). Radiused seat-wall 30 and radiused bottom end 29 of threaded stem 27 both preferably comprise a curvature that is complementary to spherical ball-valve 25.

Figure 7:
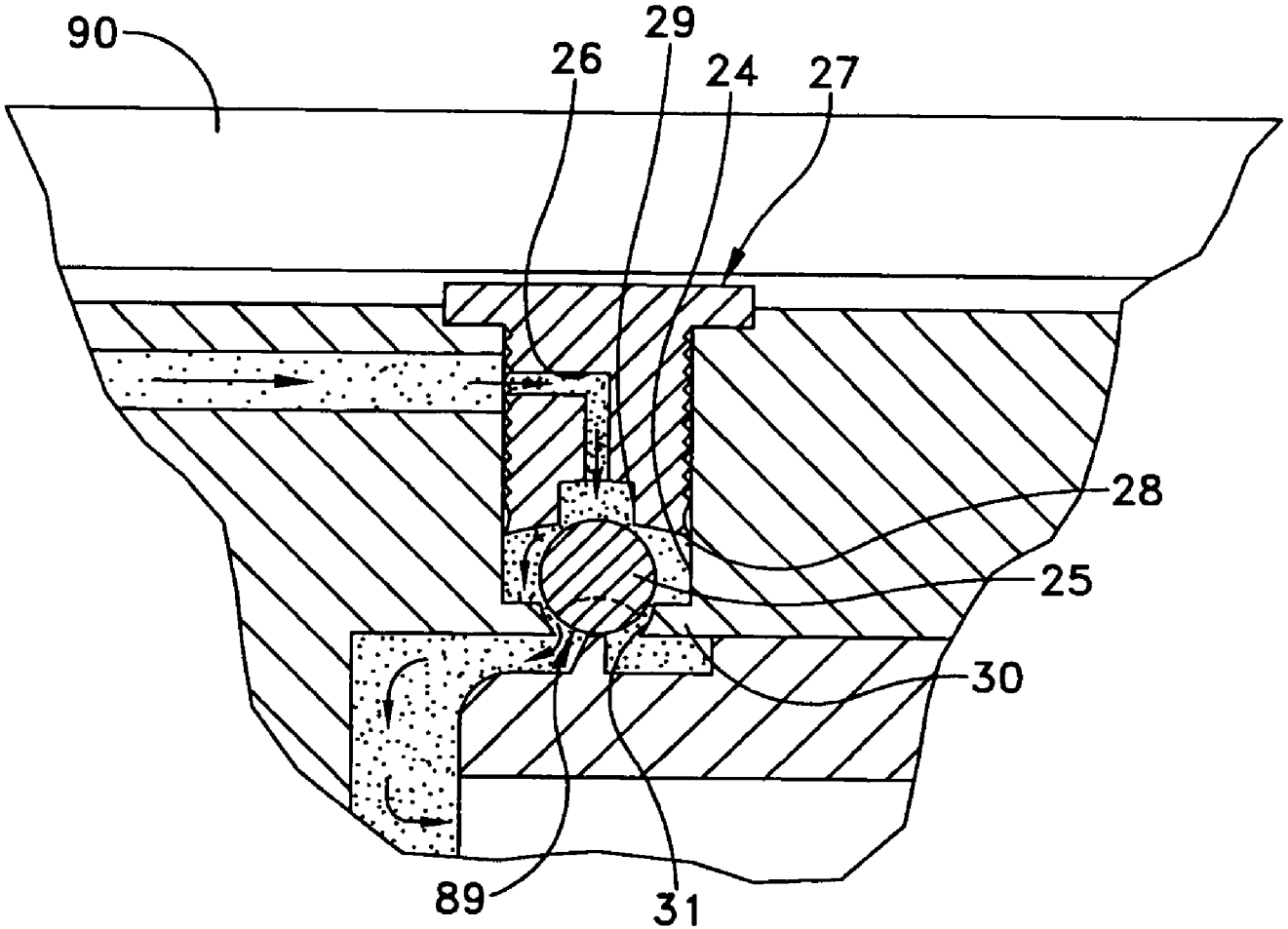
FIG. 7 is a broken-way cross-sectional view illustrating operation of a ball-valve in accordance with the present invention.

Case 10 has defined within it a first blind bore or open-ended chamber 32 and a second blind bore or open-ended chamber 33 that are arranged in spaced apart coaxial relation to one another, and in substantially parallel relation to air conduit 22. First open-ended chamber 32 often has a smaller diameter than second open-ended chamber 33. A feed-bore 34 fluidly communicates between conduit 22 and first open-ended chamber 32, and is arranged in spaced relation to threaded recess 24. Through-bore 31 of threaded recess 24 intermittently communicates with the interior of second open-ended chamber 33 via the movement of ball-valve 25 (FIG. 7). An open-ended passageway 45 is defined in a lower portion of case 10, and is disposed in substantially parallel, spaced relation to both air conduit 22 and first and second chambers 32,33. An exhaust-bore 47 fluidly communicates between second open-ended chamber 33 and open-ended passageway 45.

Figure 8:
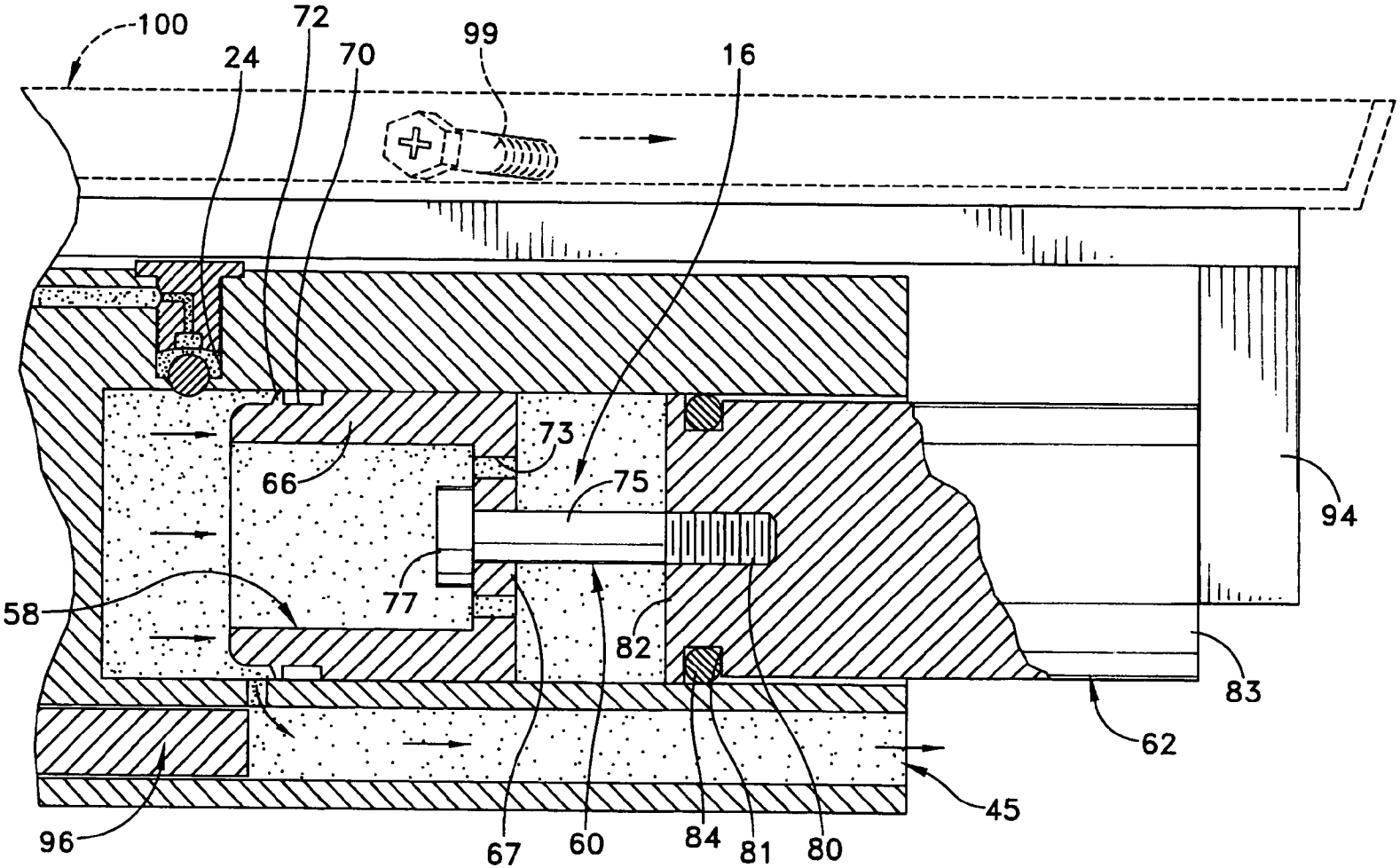
FIG. 8 is an enlarged broken-way cross-sectional view of another side portion of the asymmetrically accelerated vibrator shown in FIG. 1, showing a further stage of operation of the device in accordance with the present invention.

Piston 14 often comprises a solid cylinder of metal including an annular groove 50 defined adjacent to a first end 52. An o-ring 51 is often positioned within annular groove 50 so as to provide for a substantially airtight seal between piston 14 and the interior surface of case 10 that defines first open-ended chamber 32. A second end 53 of piston 14 is operatively interconnected with a portion of vibratory carriage 20. Referring to FIGS. 1 and 8, piston assembly 16 includes a valve 58, an adjustment pin 60, and a second piston 62. More particularly, valve 58 comprises a substantially cylindrical, open-ended profile defined by an annular outer wall 66 and a bottom wall 67. Annular outer wall 66 often includes a lead-in portion 70, a trailing portion 71, and a valve-actuator 72. Trailing portion 71 has a somewhat larger diameter than lead-in portion 70. Bottom wall 67 includes a centrally defined through-bore, with feed bores 73 arranged adjacent thereto.

Figure 9:
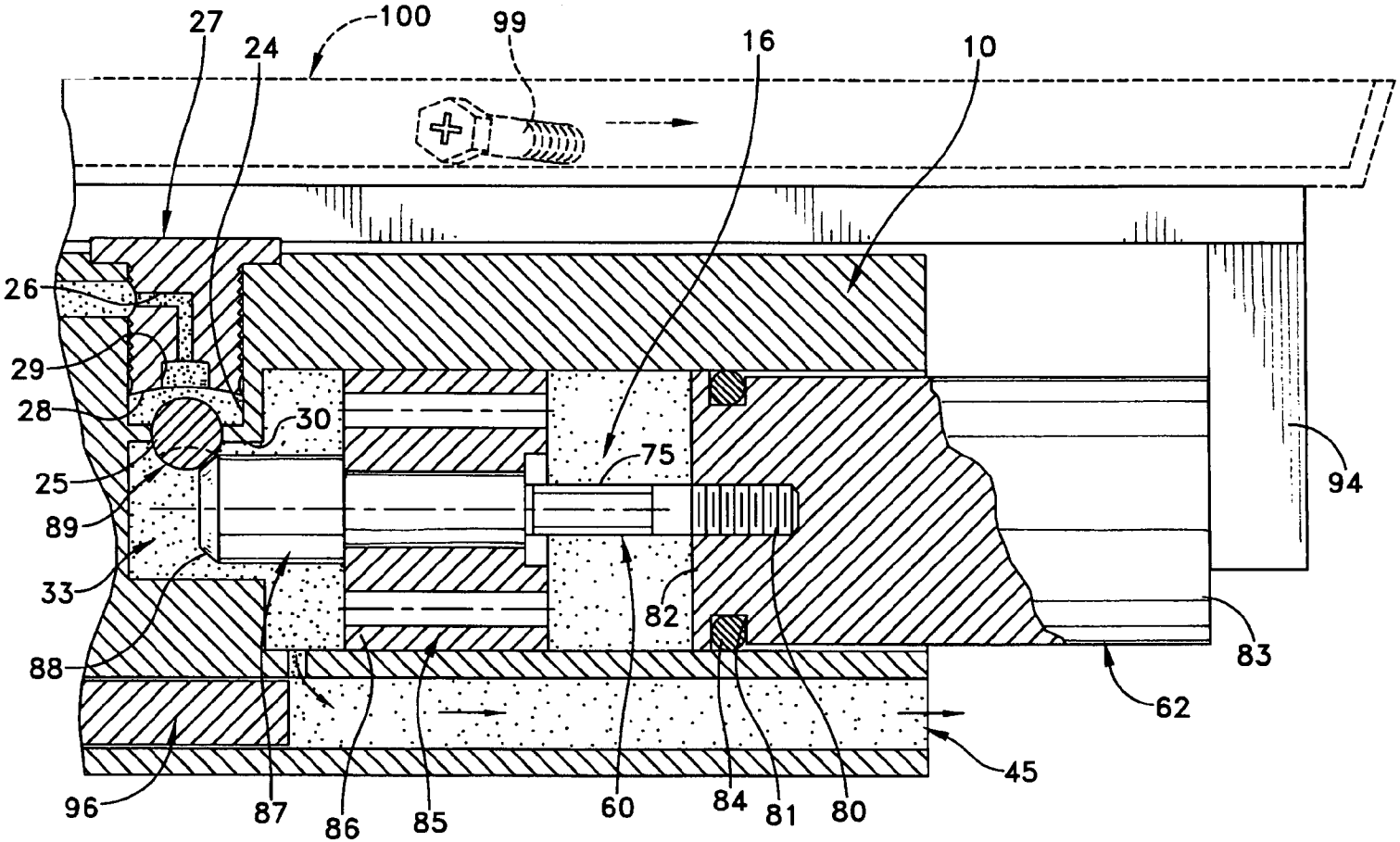
FIG. 9 is an enlarged broken-way cross-sectional view of an alternative embodiment of the invention shown in FIG. 1.

Valve-actuator 72 projects radially outwardly from the outer surface of lead-in portion 70 so as to comprise a length that extends from the outer surface of lead-in portion 70 to the interior surface of care 10 that defines second open-ended chamber 33. In an alternative embodiment, a compound valve 85 comprises a substantially cylindrical base portion 86 that is similar in general shape and size to valve 58. A valve-actuator 87 projects outwardly from a central portion of a leading end of compound valve 85, and includes a lead-in chamfer 88 (FIG. 9).

Adjustment pin 60 comprises an elongate shaft 75 having a head 77 that projects radially outwardly from a first end and a spaced-away threaded portion 80 at a second end.

Shaft 75 is sized to be slidingly passed through the bore in bottom wall 67 of valve 58, with head 77 engaging bottom 67 so that adjustment pin 60 is firmly engaged with valve 58. Second piston 62 often comprises a solid cylinder of metal including an annular groove 81 defined adjacent to a first end 82. An o-ring 84 is positioned within annular groove 81 so as to provide for a substantially air-tight seal between piston 62 and the interior surface of case 10 that defines second open-ended chamber 33. A second end 83 of piston 62 is operatively interconnected with a portion of vibratory carriage 20. Second piston 62 often has a larger diameter than first piston 14. For example, the ratio of diameters of first piston 14 to second piston 62 is often in the range of about 1 to 1.25 to about 1 to 2.

Vibratory carriage assembly 20 includes a interface plate 90, a first stop 92, a second stop 94, and a toggle-shaft 96. Interface plate 90 is positioned atop the upper portion of case 10 so as to cover the top of threaded stem 27 within threaded recess 24. First stop 92 and second stop 94 are fastened to spaced-apart ends of interface plate 90 so as to project downwardly in substantially parallel relation to case 10. In this position, first stop 92 is arranged in confronting relation to second end 53 of first piston 14 and second stop 94 is arranged in confronting relation to second end 83 of second piston 62. Toggle-shaft 96 projects outwardly from a free end 97 of first stop 94 in parallel relation to first open-ended chamber 32 and second open-ended chamber 33 so as to be received within open-ended passageway 45 in the lower portion of case 10. Toggle-shaft 96 is long enough to extend through open-ended passageway 45 and just close-off exhaust-bore 47.

An asymmetrically accelerated vibrator 5 is assembled in accordance with one embodiment of the present invention in the following manner. First piston 14 is arranged so that its first end 52 is positioned in coaxial confronting relation with first open-ended chamber 32 of case 10. O-ring 51 is positioned within annular groove 50, and then first piston 14 is moved toward case 10 until first end 52 is positioned adjacent to feed-bore 34.

Piston assembly 16 is first assembled by positioning adjustment pin 60 within bottom wall 67 of valve 58. In this position, head 77 is located flush against the interior surface of bottom 67. Threaded end 80 is threadingly engaged with a correspondingly threaded blind bore defined in first end 82 of piston 62. An o-ring 84 is positioned within groove 81 in first end 82 of piston 62. Once assembled, piston assembly 16 is arranged such that valve 58 is arranged in co-axial confronting relation with second open-ended chamber 33 of case 10. Once in this position, piston assembly 16 is moved toward case 10 so that valve 58 enters second open-ended chamber 33 while o-ring 84 engages the interior surface defining second open-ended chamber 33.

Threaded stem 27 and ball-valve 25 are also assembled to case 10. More particularly, ball-valve 25 is first dropped within recess 24 so that a portion of ball-value 25 engages seat-wall 30 such that a spherical segment 89 of ball-valve 25 extends into second open-ended chamber 33 from through-bore 31. Once in this position, threaded stem 27 is threadingly engaged with threaded recess 24 so as to retain ball-value 25 within threaded recess 24. It will be understood that as threaded stem 27 is engaged with threaded recess 24, central passageway 26, via slot 36, is arranged in open flow communication with the interior of air conduit 22.

With first piston 14 and piston assembly 16 assembled to case 10, and ball-valve 25 loosely positioned within threaded recess 24, vibratory assembly 20 may be assembled to case 10. More particularly, interface plate 90 with first stop 92 and second stop 94 projecting outwardly from spaced-apart ends is positioned in overlying relation to a top surface of case 10. Once in this position, interface plate 90 is moved toward case 10 until first stop 92 and second stop 94 are positioned adjacent to second end 53 of first piston 14 and second end 62 of piston 62, respectively. Once in this position, stops 92, 94 are releasably fastened to pistons 14, 62 by fastening means well known in the art, e.g., threaded bolts or screws. A tray 100 is then positioned atop interface plate 90 so that loose piece items, e.g., bolts 99, may be manipulated by use of asymmetrically accelerated vibrator 5.

Referring to FIGS. 5, 6, 8, and 9, asymmetrically accelerated vibrator 5 operates in the following manner. An elastic fluid, such as compressed air, is introduced through air intake port 23 into air conduit 22, such that air conduit 22, feed-bore 34, a portion of first open-ended chamber 32, and central passageway 26 are all pressurized. As a consequence, first piston 14 is forced outwardly by the pressurized gas located within the open portion of first open-ended chamber 32. As this occurs, first piston 14 moves first stop 92, and thereby, interface plate 90 and toggle-shift 96 away from case 10.

As interface plate 90 moves, under the influence of first piston 14, second stop 94 presses second end 83 of second piston 62 thereby driving piston assembly 16 inwardly into second open-ended chamber 33 of case 10. As valve 58 moves inwardly under the influence of second piston 62, valve-actuator 72 engages segment 89 of ball-valve 25 that is extending from through-bore 31 into the interior of second open ended chamber 33. As this occurs, valve-actuator 72 engages ball-valve 25 thereby dislodging it from seat-wall 30 and through-bore 31, and providing an escape pathway for the compressed air trapped in first open-ended chamber 32, air conduit 22, and feed-bore 34. Advantageously, valve-actuator 72 does not cause appreciable wear or other damage to any particular portion of ball-valve 25, since during each cycle of asymmetrically accelerated vibrator 5, a different portion of ball-valve 25 forms segment 89. This structure provides for a significant increase in the operating life of the device.

Alternatively, when using compound valve 85, as cylindrical base portion 86 moves inwardly under the influence of second piston 62, valve-actuator 87 engages segment 89 of ball-valve 25 that is extending from through-bore 31 into the interior of second open ended chamber 33. As this occurs, valve-actuator 87 engages ball-valve 25 thereby dislodging it from seat-wall 30 and through-bore 31, and providing an escape pathway for the compressed air trapped in first open-ended chamber 32, air conduit 22, and feed-bore 34. Advantageously, valve-actuator 87 does not cause appreciable wear or other damage to any particular portion of ball-valve 25, since during each cycle of asymmetrically accelerated vibrator 5, a different portion of ball-valve 25 forms segment 89 which is engaged by chamfered lead-in 88. (FIG. 9).

As a result, compressed air flows through central passageway 26 and into second open-ended chamber 33. At the same time, toggle-shaft 96 uncovers exhaust port 47 so that the compressed air can escape second open-ended chamber 33 into the ambient environment. As compressed air fills second open-ended chamber 33, piston assembly 16 is caused to move outwardly under the influence of the pressurized air. As this happens, second end 83 of piston 62 engages second stop 94 of vibratory assembly 20, thereby reversing the movement of interface plate 90 and first stop 92. As a consequence, first stop 92 presses first end 53 of first piston 14 driving first piston 14 back into first open-ended chamber 32. As a consequence of this reversing movement, piston assembly 16 is moved outwardly again disengaging valve-actuator 72 from segment 89 of ball-valve 25, thereby allowing ball-valve 25 to be positioned in seat-wall 30 thereby reblocking through-bore 31. Once this occurs, the pressurized air from air intake 23 once again pressurizes air conduit 22, feed-bore 34, and first open-ended chamber 32 thereby causing a new cycle of operation of asymmetrically accelerated vibrator 5.

Asymmetric accelerated vibrator 5 allows removal of parts and material from areas which are inaccessible or inconvenient to reach by other means such as under a machine or a punch press. In addition asymmetric accelerated vibrator 5 does not require any electrical connections since it is operated by compressed air. This allows application of this device in areas where electrical currents and voltages are to be avoided. If an inclined tray is attached to one asymmetric accelerated vibrator 5, this can be followed by more inclined trays so as to provide an upward motion of material placed on the trays during operation of each Asymmetric accelerated vibrator 5. Preferably asymmetrically accelerated vibrator 5 runs at about 300 to 550 strokes per minute.

It is to be understood that the present invention is by no means limited only to the particular constructions herein disclosed and shown in the drawings, but also comprises any modifications or equivalents within the scope of the claims.

What is claimed is:

1. An asymmetrically accelerated vibrator comprising:

a case having a first bore and a second bore arranged in coaxial relation to one another and in regulated fluid communication with a source of compressed fluid wherein a compressed fluid conduit is defined within said case, and arranged in fluid communication between a compressed fluid intake port and a threaded recess that is defined in said case;

a first piston having a first diameter disposed in said first bore;

a second piston having a second diameter disposed in said second bore;

a mechanical connection between said first and second pistons such that said pistons are caused to oscillate in unison by regulated application of compressed fluid from said compressed fluid source; and a ball-valve disposed in fluid regulatory relation between said first bore, said second bore, and said source of compressed fluid so as to switch a flow of said compressed fluid between said first bore and said second bore upon interaction with a portion of said second piston.

2. An asymmetrically accelerated vibrator according to claim 1 wherein said threaded recess is sized and shaped to receive a substantially spherical ball-valve.

3. An asymmetrically accelerated vibrator according to claim 1 wherein said threaded recess is sized and shaped to receive a correspondingly threaded stem.

4. An asymmetrically accelerated vibrator according to claim 3 wherein said threaded stem includes a radiused bottom end and a central passageway arranged in fluid communication with an opening located within threads disposed upon an outer surface and a semi-circumferential slot which intersects with said opening.

5. An asymmetrically accelerated vibrator according to claim 4 wherein said threaded recess comprises a radiused seat-wall having a centrally defined through-bore that provides for fluid communication with said central passageway defined in the interior of said threaded stem.

6. An asymmetrically accelerated vibrator according to claim 5 wherein said radiused seat-wall comprises a curvature that is complementary to a spherical ball-valve.

7. An asymmetrically accelerated vibrator according to claim 5 wherein said through-bore of said threaded recess communicates with said first bore upon movement of said ball-valve.

8. An asymmetrically accelerated vibrator according to claim 1 wherein said first bore and said second bore are arranged in spaced apart coaxial relation to one another, and in substantially parallel relation to said compressed fluid conduit.

9. An asymmetrically accelerated vibrator according to claim 1 wherein said first bore comprises a smaller diameter than said second bore, and a feed-bore fluidly communicates between said compressed fluid conduit and said first bore, and in spaced relation to said threaded recess.

10. An asymmetrically accelerated vibrator according to claim 1 wherein an open-ended passageway is defined in a lower portion of said case, and is disposed in substantially parallel, spaced relation to said first and second bores, and an exhaust-bore is defined in said case adjacent to an end of said open-ended passageway so as to fluidly communicate between said second bore and said open-ended passageway.

11. An asymmetrically accelerated vibrator according to claim 1, wherein said second piston includes a valve positioned within said second bore, and comprising a substantially cylindrical, open-ended profile defined by an annular outer wall and a bottom wall.

12. An asymmetrically accelerated vibrator according to claim 11 wherein said annular outer wall includes a lead-in portion having an outer surface and a ball-valve-actuator that projects radially outwardly from said outer surface.

13. An asymmetrically accelerated vibrator comprising:

a case having a first bore and a second bore arranged in coaxial relation to one another and in regulated fluid communication with a source of compressed fluid wherein a compressed fluid conduit is defined within said case, and arranged in fluid communication between a compressed fluid intake port and a threaded recess that is defined in said case;

a first piston having a first diameter disposed in said first bore;

a second piston having a second diameter disposed in said second bore;

a mechanical connection between said first and second pistons such that said pistons are caused to oscillate in unison by regulated application of compressed fluid from said compressed fluid source; and a ball-valve that is formed from a light weight, wear and corrosion resistant material disposed in fluid regulatory relation between said first bore, said second bore, and said source of compressed fluid so as to switch a flow of said compressed fluid between said first bore and said second bore upon interaction with a portion of said second piston.

14. An asymmetrically accelerated vibrator comprising:

a case having a first open-ended chamber and a second open-ended chamber arranged in coaxial relation to one another and in regulated fluid communication with a source of compressed fluid;

a first piston having a first diameter disposed in said first open-ended chamber;

a second piston having a second diameter disposed in said second open-ended chamber;

a compressed fluid conduit defined within said case and arranged in fluid communication between a compressed fluid intake port and a threaded recess that is defined in said case between said first open-ended chamber and said second open-ended chamber wherein said threaded recess is terminated by a radiused seat-wall having a through-bore that opens into said second open-ended chamber;

a mechanical connection between said first and second pistons such that those pistons are caused to oscillate in unison by regulated application of compressed fluid from said compressed fluid source; and a ball-valve disposed in said threaded recess such that when said ball-valve is engaging said seat-wall, a segment of said ball-valve projects into said second open-ended chamber so as to be engagable by a portion of said second piston and thereby to provide fluid regulation between said first open-ended chamber, said second open-ended chamber, and said source of compressed fluid so as to switch a flow of said compressed fluid between said first open-ended chamber and said second open-ended chamber upon interaction of said segment with said portion of said second piston.

15. An asymmetrically accelerated vibrator according to claim 14 wherein said threaded recess is sized and shaped to receive a substanially spherical ball-valve.

16. An asymmetrically accelerated vibrator according to claim 14 wherein said threaded recess is sized and shaped to receive a correspondingly threaded stem that releaseably closes off said threaded recess.

17. An asymmetrically accelerated vibrator according to claim 14 wherein said ball-valve is formed from a light weight, wear and corrosion resistant material.

18. An asymmetrically accelerated vibrator according to claim 17 wherein said threaded stem includes a radiused bottom end and a central passageway arranged in fluid communication with an opening located within threads disposed upon an outer surface and a semi-circumferential slot which intersects with said opening.

19. An asymmetrically accelerated vibrator according to claim 18 said threaded recess comprises a radiused seat-wall has a centrally defined through-bore that provides for fluid communication with a central passageway defined in the interior of said threaded stem.

20. An asymmetrically accelerated vibrator according to claim 19 wherein said radiused seat-wall comprises a curvature that is complementary to a spherical ball-valve.

21. An asymmetrically accelerated vibrator according to claim 14 wherein said first open-ended chamber and said second open-ended chamber are arranged in spaced apart coaxial relation to one another, and in substantially parallel relation to said compressed fluid conduit.

22. An asymmetrically accelerated vibrator according to claim 14 wherein said first open-ended chamber comprises a smaller diameter than said second open-ended chamber, and a feed-bore fluidly communicates between said compressed fluid conduit and said first open-ended chamber, and in spaced relation to said threaded recess.

23. An asymmetrically accelerated vibrator according to claim 22 wherein said through-bore of said threaded recess communicates with said first open-ended chamber upon movement of said ball-valve.

24. An asymmetrically accelerated vibrator according to claim 14 wherein an open-ended passageway is defined in a lower portion of said case, and is disposed in substantially parallel, spaced relation to said first and second open-ended chambers, and an exhaust-bore is defined in said case adjacent to an end of said open-ended passageway so as to fluidly communicate between said second open-ended chamber and said open-ended passageway.

25. An asymmetrically accelerated vibrator according to claim 14 wherein said second piston includes a valve positioned within said second open-ended chamber, and comprising a substantially cylindrical, open-ended profile defined by an annular outer wall and a bottom wall.

26. An asymmetrically accelerated vibrator according to claim 25 wherein said annular outer wall includes a lead-in portion having an outer surface and a ball-valve-actuator that projects radially outwardly from said outer surface.

27. An asymmetrically accelerated vibrator comprising:

a case having a first bore and a second bore arranged in coaxial relation to one another and in regulated fluid communication with a source of compressed fluid, wherein a compressed fluid conduit is defined within said case, and arranged in fluid communication between a compressed fluid intake port and a threaded recess that is defined in said case;

a first piston having a first diameter disposed in said first bore;

a second piston having a second diameter disposed in said second bore and including a compound valve positioned within said second bore, and comprising a valve-actuator projecting therefrom, said valve-actuator including a chamfered end;

a mechanical connection between said first and second pistons such that said pistons are caused to oscillate in unison by regulated application of compressed fluid from said compressed fluid source; and a ball-valve disposed in fluid regulatory relation between said first bore, said second bore, and said source of compressed fluid so as to switch a flow of said compressed fluid between said first bore and said second bore upon interaction with said chamfered end.

* * * * *

UNITED STATES PATENT AND TRADEMARK OFFICE

CERTIFICATE OF CORRECTION

PATENT NO. : 6,971,301 B2
DATED : November 10, 2003
INVENTOR(S) : Michael S. Leslie It is certified that error appears in the above-identified patent and that said Letters Patent is hereby corrected as shown below:

Title page,
Item [73], Assignee, "vibro" should be -- Vibro --.

Column 9,
Line 26, "substanially" should be -- substantially --.

Signed and Sealed this

Eighteenth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,971,301 B2
DATED : December 6, 2005
INVENTOR(S) : Leroy A. Johnson It is certified that error appears in the above-identified patent and that said Letters Patent is hereby corrected as shown below:

Title page,
Item [73], Assignee, "vibro" should be -- Vibro --.

Column 9,
Line 26, "substanially" should be -- substantially --.

This certificate supersedes Certificate of Correction issued April 18, 2006.

Signed and Sealed this

Ninth Day of May, 2006

JON W. DUDAS
*Director of the United States Patent and Trademark Office*